US005226778A

United States Patent [19]

Sekitani

[11] Patent Number: 5,226,778

[45] Date of Patent: Jul. 13, 1993

[54] YARN SUPPLY DEVICE FOR AUTOMATIC WINDER

[75] Inventor: Noboru Sekitani, Ohtsu, Japan

[73] Assignee: Murata Kikai Kabushiki Kaisha, Kyoto, Japan

[21] Appl. No.: 968,263

[22] Filed: Oct. 30, 1992

Related U.S. Application Data

[63] Continuation of Ser. No. 584,460, Sep. 18, 1990, abandoned.

[30] Foreign Application Priority Data

Sep. 28, 1989 [JP] Japan ..... 1-252671

[51] Int. Cl.[5] ..... B65G 60/00

[52] U.S. Cl. ..... 414/744.3; 414/796.9; 414/223; 414/331; 414/911

[58] Field of Search ..... 414/222, 223, 225, 226, 414/331, 403, 416, 618, 908, 910, 911, 795.4, 796.5, 795.6, 795.7, 796.9, 744.3, 27, 792.2, 792.3, 793.9; 104/47; 198/832.1, 345.2; 242/130, 130.3

[56] References Cited

U.S. PATENT DOCUMENTS

| | | | |
|---|---|---|---|
| 3,241,656 | 3/1966 | Thornton | 198/345.2 |
| 3,556,315 | 1/1971 | Berger | 414/618 |
| 3,904,097 | 9/1975 | Grambo, Jr. et al. | 414/911 X |
| 3,924,762 | 12/1975 | Igel | 414/331 |
| 4,024,959 | 5/1977 | Gruner | 414/618 X |
| 4,197,772 | 4/1980 | Anderson et al. | 414/744.3 X |
| 4,226,567 | 10/1980 | Van Orsdale, Jr. | 414/744.3 X |
| 4,380,939 | 4/1983 | Gardner | 198/345.2 X |
| 4,451,191 | 5/1984 | Torre | 414/796.9 X |
| 4,464,846 | 8/1984 | Itoh et al. | 414/223 X |
| 4,502,830 | 3/1985 | Inaba et al. | 414/744.3 X |
| 4,504,186 | 3/1985 | Richards | 414/911 X |
| 4,515,328 | 5/1985 | Payne, Jr. | 414/331 X |
| 4,555,215 | 11/1985 | Raasch et al. | 414/331 X |
| 4,589,811 | 5/1986 | Riccardo et al. | 414/911 X |
| 4,596,505 | 6/1986 | Seelinger | 414/911 X |
| 4,669,942 | 6/1987 | Nagasawa | 414/331 |
| 4,682,929 | 7/1987 | Kataoka | 414/911 X |
| 4,702,663 | 10/1987 | Mischke et al. | 414/618 |
| 4,723,884 | 2/1988 | Brinker et al. | 414/416 X |
| 4,723,885 | 2/1988 | Grube et al. | 414/911 X |
| 4,764,078 | 8/1988 | Neri | 414/225 X |
| 4,783,021 | 11/1988 | Nagasawa | 414/331 X |
| 4,988,252 | 1/1991 | Yamamoto et al. | 414/331 |
| 4,992,016 | 2/1991 | Ferloni | 414/910 X |

FOREIGN PATENT DOCUMENTS

| | | | |
|---|---|---|---|
| 0311986 | 4/1989 | European Pat. Off. | 414/27 |
| 0061222 | 5/1981 | Japan | 198/832.1 |
| 0100923 | 4/1990 | Japan | 414/911 |

*Primary Examiner*—Michael S. Huppert
*Assistant Examiner*—James T. Eller, Jr.
*Attorney, Agent, or Firm*—Spensley, Horn, Jubas & Lubitz

[57] ABSTRACT

A supply yarn fitting device and a reserving section are provided in a supply section, and either the supply yarn fitting device is constituted such that it can fit supply yarns such as packages from a plurality of reserving locations or the reserving section is constituted as a supply yarn reserving device having a function of supplementing supply yarns to a reserving location in response to operation of the supply yarn fitting device so that supply yarns may be supplied automatically onto a transport passage in the yarn supply section.

7 Claims, 7 Drawing Sheets

YARN SUPPLY DEVICE FOR AUTOMATIC WINDER

This is a continuation of application Ser. No. 07/584,460 filed on Sep. 18, 1990, now abandoned.

FIELD OF THE INVENTION

This invention relates to a yarn supply device for an automatic winder, and particularly to a yarn supply device for a winder of the cone-to-cone type.

RELATED ART STATEMENT

Generally, a winder of the cone-to-cone type is known as a winder which accepts a large package as a supply yarn and rewinds the supply yarn into an arbitrary profile, such as reforming after a dyeing step or rewinding into a cone from a cheese doffed from an open end spinning or pneumatic spinning frame of the rotor type.

In a cone-to-cone winder, a supply yarn is greater in size compared with a spinning bobbin, such that it has an outer diameter and a weight several times greater than that of a spinning bobbin, and accordingly, supply of a supply yarn is not automated.

For example, a method is adapted wherein one to three standby stations are provided for each winding unit and a supply yarn is supplied by manual operation. Even in the case wherein transportation and winding are performed using a peg tray while a yarn supply section is provided outside of the winding units and discharged bobbins and supply bobbins are transported by means of a conveyor, a supplying operation of a supply yarn is performed by manual operation (see the Official Gazette of Japanese Patent Laid-Open No. 59-223667, applied for by the present applicant).

The method of the application is such that a yarn supply section is provided adjacent a plurality of winding units and connected to the winding units by way of an empty bobbin conveyor and a supply yarn supply conveyor. A peg tray, on which an empty bobbin discharged from a winding unit is fitted uprightly, is transported to and reserved once on the yarn supply section by way of the empty bobbin conveyor. Then after pulling off of such empty bobbin from the peg tray, the supply of a supply yarn and the processing of an end of the yarn are performed by manual operation on the yarn supply station, and the peg tray is sent out onto the yarn supply conveyor in response to a request of a winding unit. According to the method, working is concentrated in time and space compared with other methods wherein supply yarns are supplied to individual units.

Meanwhile, as to automation of a yarn supply section for a cone-to-cone winder, automation has already been achieved with an empty bobbin pulling off device and a yarn end picking up device (finding device), but automation has not yet been realized for the fitting operation of supply yarns because a successive supplementing method of supply yarns is not combined.

It is pointed out that, with the method of the application described above, the quantity of reserved supply yarns is small because the reservation of supply yarns is limited to a location on a conveyor of a single row, and a sufficient concentration in time and space in performing working is not achieved.

OBJECT AND SUMMARY OF THE INVENTION

The present invention makes it possible to achieve concentration in space and time for the preparation of supply yarns by automating the fitting of supply yarns, which is conventionally performed by manual operation, to thereby enable the automation of all operations at a supply yarn supply section and simultaneously by employing a three-dimensional reserving method.

A supply yarn fitting device and a reserving section are provided in a supply section. The supply yarn fitting device may be constituted such that it can fit supply yarns such as packages, from a plurality of reserving locations. Alternatively, the reserving section may be constituted as a supply yarn reserving device having a function of supplementing supply yarns to a reserving location in response to the operation of the supply yarn fitting device, so that supply yarns may be supplied automatically onto a transport passage in the yarn supply section.

A peg onto which a supply yarn from which an empty bobbin has been pulled off is fed to a supply position of a supply yarn, and a supply yarn is transported from the yarn reserving device and fitted onto the peg by operation of the supply yarn fitting device.

In this instance, the supply yarn fitting device may be moved, or part of the supply yarn fitting device may be moved, to allow fitting from a plurality of reserving locations. Alternately, the supply yarn reserving device may be constituted as a supply yarn reserving device having a function of supplementing a supply yarn in response to the operation of the supply yarn fitting device to allow successive fitting of supply yarns.

DETAILED DESCRIPTION OF PREFERRED EMBODIMENT

Figure 1:
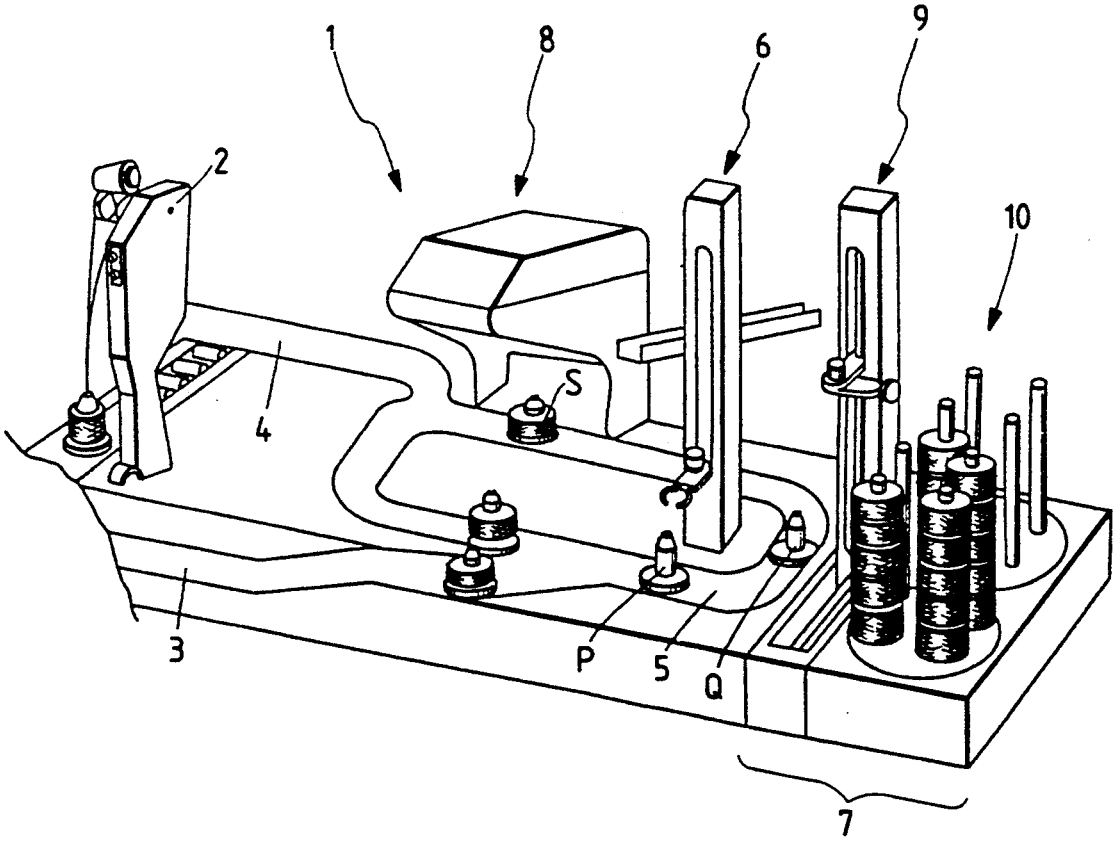
FIG. 1 is an entire view of a winder showing a first embodiment.

General arrangement of an automatic winder according to the present invention is shown in FIG. 1. A plurality of winding units 2 and a yarn supply section 1 are connected to each other by way of an empty tray conveyor 3 and an occupied tray conveyor 4. An annular conveyor 5 is provided in the yarn supply section 1, and an empty bobbin pulling off device 6, a supply yarn supply device 7 and a yarn end finding device 8 are provided along the annular conveyor 5. Further, the supply yarn supply device 7 can be divided into a supply yarn fitting device 9 and a supply yarn reserving device 10.

A peg tray on which an empty bobbin discharged from a winding unit 2 is received is fed on the empty tray conveyor 3 and undergoes a pulling off operation of the empty bobbin at a point P on the annular conveyor 5, and the emptied tray is transported to a point Q at which it accepts supply of a supply yarn by the supply yarn supply device 7 and then undergoes a yarn end finding operation by the yarn end finding device 8 at a point S, whereafter it is transported to a winding unit 2 by the occupied tray conveyor 4.

As an embodiment 1, an example is shown wherein the supply yarn reserving device has two turrets so as to perform supply of supply yarns of two kinds (the two kinds will be hereinafter referred to as A and B).

Figure 3:
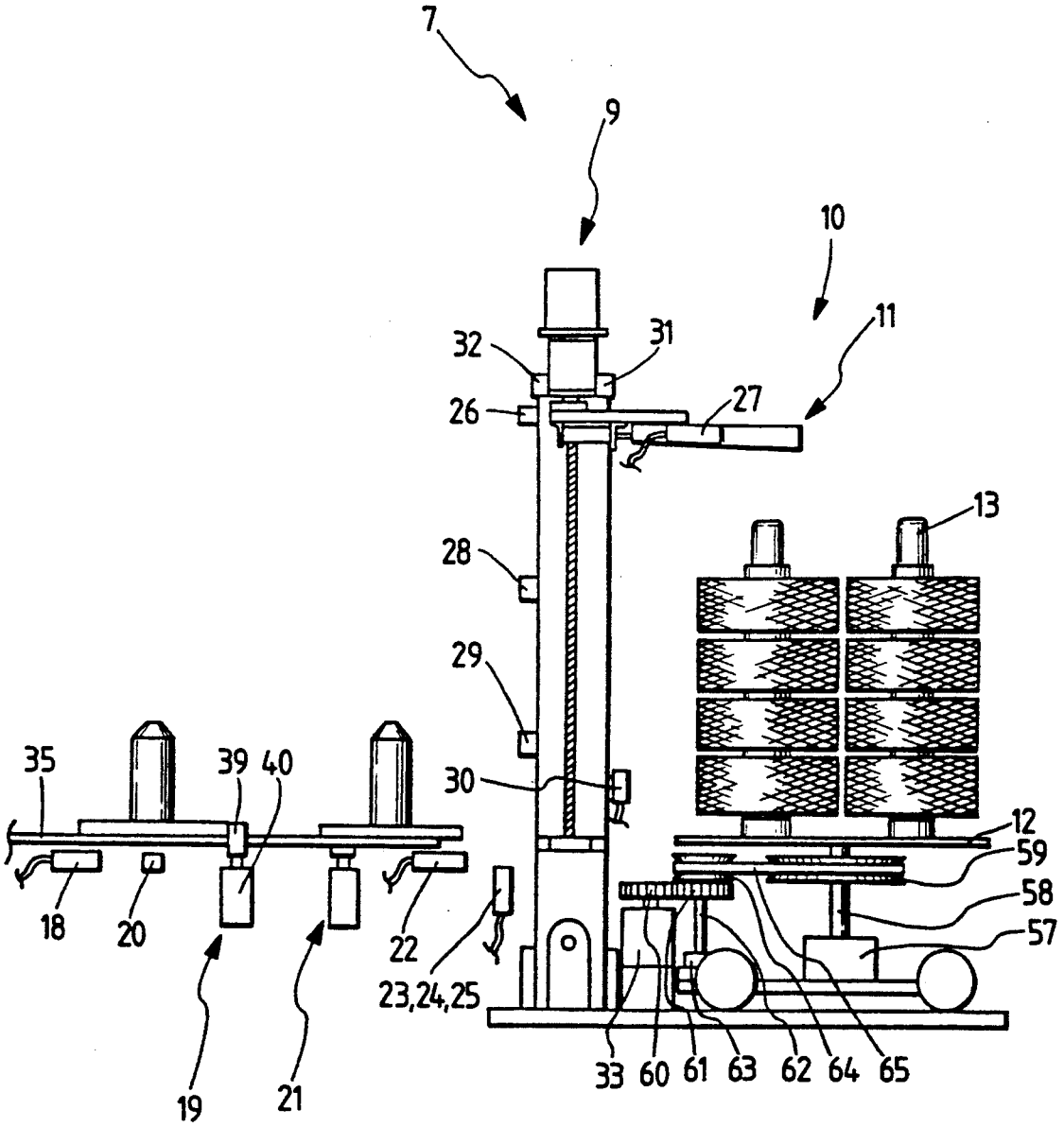
FIGS. 3 and 4 are a front elevational view and a plan view of the same.
Figure 4:
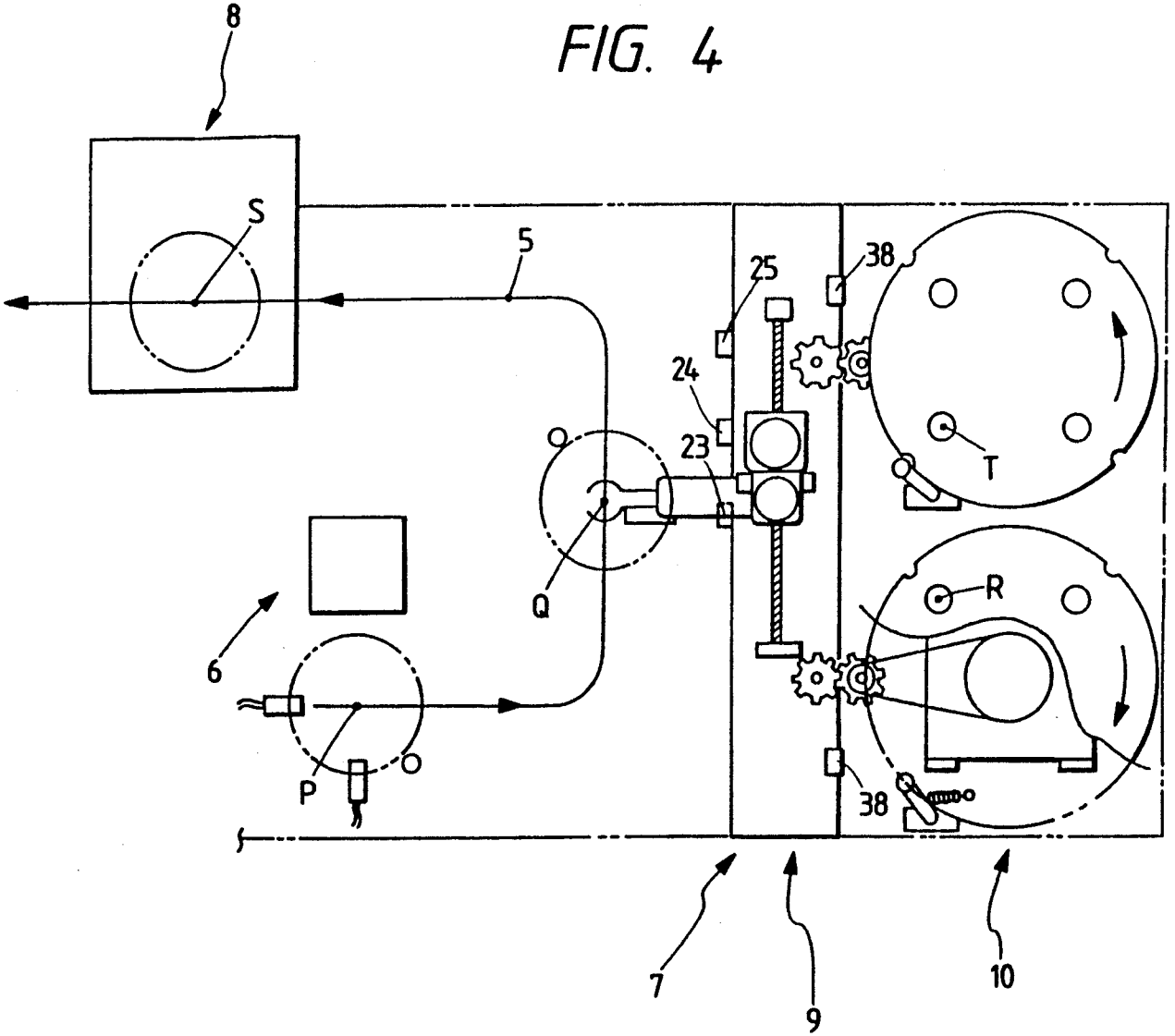

Along the annular conveyor 5, a pair of tray stoppers 19 and 21 and a pair of proximity sensors 20 and 22 for detecting the presence or absence of a tray are mounted at the empty bobbin pulling off position P and the supply yarn fitting position Q while a further proximity sensor 18 for the discrimination of a kind of supply yarn is mounted at the empty bobbin pulling off position P as shown in FIGS. 3 and 4. Discrimination of a kind of supply yarn is performed based on the presence or absence of a ring made of metal and mounted on a bottom face of a tray. The stoppers are each rendered operative when a cylindrical member 39 is pushed up by an air cylinder 40 but is disengaged when the cylindrical member 39 is pulled down.

Figure 2:
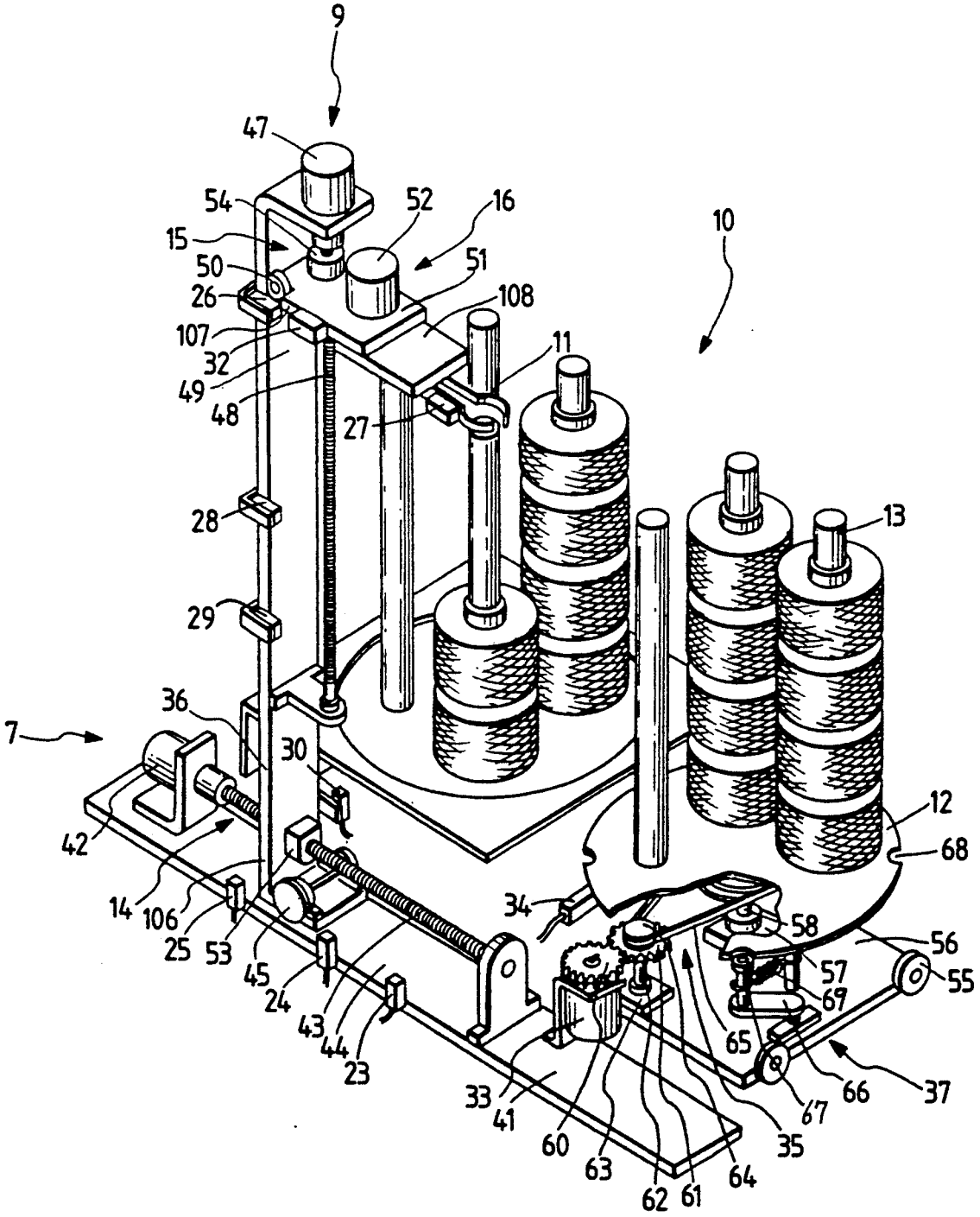
FIG. 2 is a detailed view of a supply yarn supply device of the embodiment.

In the following, the construction of the supply yarn supply device 7, which is a principal component of the present embodiment, will be described mainly with reference to FIG. 2. It is to be noted that the proximity sensor 31 cannot be shown in FIG. 2, but the location thereof can be confirmed in FIG. 3. Meanwhile, the description of a chuck 11 will be given with reference to FIG. 6.

A chuck 11 for grasping a neck portion of a supply yarn is mounted for rotation, for up and down movement and also for travelling movement on the supply yarn fitting device 9. The chuck 11 may be rotated between the fitting position Q and a supply yarn grasping position T or R, and the chuck 11 may travel in the upward and downward directions in FIG. 4. Reference numerals 14, 15 and 16 denote individual moving means. While a ball screw and a nut are employed for the parallel movement of the moving means 14 and 15 in the present embodiment, it is also possible to employ some other method.

A motor 42 is secured to a base 41 of the supply yarn fitting device 9, and a ball screw 43 is mounted on the base 41 such that it may be driven to rotate by the motor 42. A nut 53 in which the ball screw 43 is screwed is mounted on a travelling platform 36 on which two rollers 45 for contacting with an upper face 44 of the base 41 are mounted for rotation. Consequently, the travelling platform 36 can be travel in the upward and downward directions in FIG. 4 due to the motor 42. Meanwhile, reference numerals 23, 24 and 25 denote proximity sensors for individually detecting a position of the travelling platform. By detecting a travelling platform side face 106 of the travelling platform 36, the position R for the grasping of a supply yarn of the kind B, the supply yarn fitting position Q, or the grasping position T of a supply yarn of the kind A by the chuck 11 is indicated.

A motor 47 is secured to the travelling platform 36, and a ball screw 48 is mounted on the travelling platform 36 such that it may be driven to rotate by the motor 47. A nut 54 in which the ball screw 48 is screwed is mounted on a chuck platform 51 on which two rollers 50 for contacting with a vertical face 49 of the travelling platform 36 are mounted for rotation. Consequently, the chuck platform 51 can be travel in the vertical direction due to the motor 47. Proximity sensors 26, 27 and 28 are mounted on the travelling platform 36. By detecting a chuck platform side face 107, the height of an upper end of a vertical stroke, supply standby or supply yarn fitting of the chuck platform 51 is indicated. Further, a photoelectric sensor 30 for detecting the presence or absence of a supply yarn fitted on a bar-like member 31 is mounted on the travelling platform 36.

A motor 52 is secured to the chuck platform 51, and the chuck platform 11 to which rotational movement (swinging movement of 180 degrees) is provided by the motor 52 is mounted on the chuck platform 51. Further, proximity sensors 31 and 32 are mounted on the chuck platform 51 and indicate, by detecting a chuck upper face 108, positions of supply yarn grasping and supply yarn fitting by rotation of the chuck.

Figure 6:
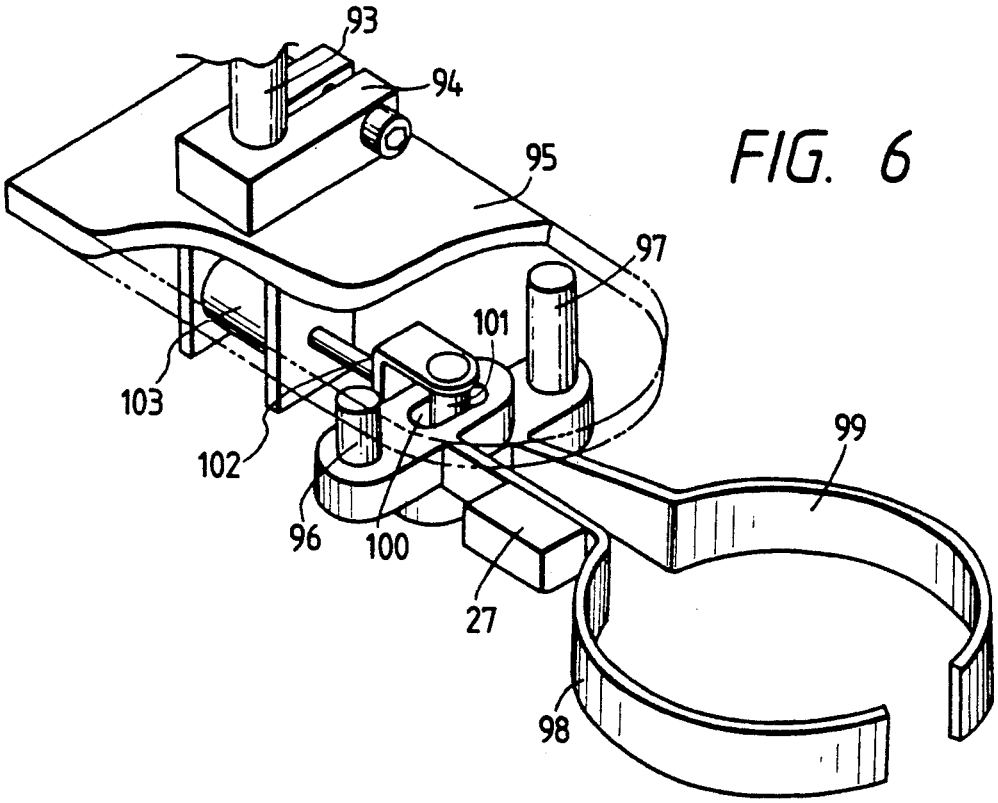
FIG. 6 is a detailed view of a chuck.

Details of the chuck 11 will be described with reference to FIG. 6. A plate-like member 95 is mounted on a shaft 93 of the motor 52 by means of a fastening section 94, and chuck members 98 and 99 are mounted for pivotal motion on pivot shafts 96 and 97 secured to the plate-like member 95. A channel-shaped member 102, secured to a shaft 101 extending through elongated holes 100 perforated in the two chuck members 98 and 99, is connected to a rod of an air cylinder 103 secured to the plate-like member 95. Consequently, a chucking operation is performed by causing the air cylinder 103 to operate in a direction to the left interior in FIG. 6. A photoelectric sensor 27, for indicating the height of the downward movement of the chuck 11 upon grasping of a supply yarn by detecting an upper face of a yarn layer of the supply yarn, is mounted on the chuck member 98.

The supply yarn reserving device 10 is constituted from two turret platforms 56, and four bar-like members 13 are erected uprightly on a turret 12 mounted on each of the turret platforms 56 such that cheeses of supply yarns can be fitted uprightly and reserved on each of the bar-like members 13. While each of the turret platforms 56 can be separated and moved away from the supply yarn fitting device 9, rotation is transmitted to each of the turret platforms 56 by way of driving transmitting means 35 from a motor 33 placed in the supply yarn fitting device 9.

Shafts 57 and 63 are secured to the turret platforms 56 having wheels 55 thereon, and a shaft 58 of a turret having a pulley 59 thereon is mounted on a bearing 57. A shaft 62 for a gear 61 and a pulley 64 is mounted on another bearing 63. A belt 65 extends between the pulleys 59 and 64. Meanwhile, the motor 33 having a shaft on which a gear 60 is mounted is secured to the base 41 of the supply yarn fitting device 9. By installing one of the turret platforms 56 at a position in which the gear 60 meshes with the gear 61, the turret 12 is driven by the motor 33.

A turret positioning mechanism 37 is provided for each of the turret platforms 56. A member 66 having a roller 67 thereon is supported for pivotal motion on each of the turret platforms 56 such that the roller 67 thereof contacts with a circumferential edge of the turret and is urged by a spring 69 such that the roller 67 may have a contacting force acting toward the center of the turret. Each of the turrets has four recesses 68 so that it may be positioned such that it may not be rotated by a force lower than a fixed rotational torque, for example, by a force caused by vibrations from a position in which the roller 67 is contacted under pressure with one of the recesses 68.

A proximity sensor 34 is mounted at a location on the base 41 of the supply yarn fitting device 9 at which a recess 68 is detected, and indicates a fixed position in turret rotation.

Next, the general operation of the yarn supply section will be described. A peg tray which has been transported to the empty bobbin pulling off position P and on which an empty bobbin is placed is temporarily stopped by the stopper 19 and undergoes a pulling off operation. At the same time, the discrimination of the kind of supply yarn to be supplied to the peg tray is performed. At the same time when the discrimination is performed, the operation of the fitting device is started. Further, after the pulling off operation of the empty bobbin is completed, the emptied tray is sent out to the supply yarn fitting position Q. One of the supply yarns fitted uprightly on one of the bar-like members 13 of the supply yarn reserving device 10 by the supply yarn fitting device 9 is transported to a supply standby position. After the arrival of an empty tray, the supply yarn is fitted onto the tray and sent out from the point Q to a point S. In this instance, the presence or absence of the supply yarn to be supplied in a next cycle is determined by the photoelectric sensor 30. If necessary, the turret 12 is rotated to prepare the supply yarn.

In the following, details of operation of the supply yarn fitting device 9 will be described.

After the kind of tray present at the point P is discriminated by the proximity sensor 18 and it is confirmed that no tray is present at the point Q, the operation of the supply yarn fitting is started. In a standby condition, the travelling platform 36 is at the supply yarn fitting position Q (as indicated by the proximity sensor 24) and the chuck platform 51 is at the upper end of the vertical stroke (as indicated by the proximity sensor 26) while the chuck 11 is at the supply yarn grasping position (as indicated by the proximity sensor 31).

Simultaneously, as discrimination is performed, the travelling means 14 operates in the counterclockwise direction or in the clockwise direction in response to a kind A or B, so that the travelling platform 36 is transported from the point Q to the A kind grasping position R or the B kind grasping position T. The stopping position R or T is given by the sensor 23 or 25. In the meantime, the empty bobbin pulling off operation by the empty bobbin pulling off device 6 is completed, and the tray stopper 19 at the point P is temporarily opened so that the emptied tray is sent out to the point Q.

Downward movement of the chuck 11 is performed by counterclockwise rotation of the lowering means 15, and the chuck 11 is moved down to a position at which the photoelectric sensor 27 detects a yarn layer of the supply yarn, and then the chuck 11 operates to grasp the supply yarn thereon and is then moved up to the position of the proximity sensor 26 at the upper end of the vertical stroke.

The travelling platform 36 is returned, when the travelling means 14 operates in the clockwise or counterclockwise direction, to the supply yarn fitting position Q at which it is detected by the proximity sensor 24. The chuck is rotated, by clockwise rotation of the motor 52, to the supply yarn fitting position indicated by the proximity sensor 32 so that it is positioned above the point Q of the annular conveyor 5.

The chuck platform 51 is moved down to the supply standby position indicated by the proximity sensor 28 and waits arrival to the point Q of an empty tray sent out from the point P. After an empty tray arrives, the chuck platform 51 is moved down to the supply yarn fitting height indicated by the proximity sensor 29, and the chuck 11 is opened and the supply yarn is fitted onto the empty tray. In case arrival of an empty tray at the point Q takes place prior to downward movement of the chuck platform 51 to the supply standby position, the chuck platform does not wait but is moved down as it is.

The chuck platform 51 is moved up to a position indicated by the proximity sensor at the upper end of the vertical stroke and the chuck 11 is rotated to a position indicated by the proximity sensor 31 at the supply yarn fitting position, thereby completing one cycle of supply yarn fitting operation.

After the chuck during supply yarn fitting operation grasps a supply yarn bobbin and starts upward movement to the upper end of the vertical stroke, presence or absence of a supply yarn fitted on the opposing bar-like member 13 is discriminated, and in case there is no supply yarn, the turret driving motor 33 is rotated to rotate the turret 12 by way of the driving transmitting means 37 until the sensor 34 detects and the turret is stopped at a position at which it is stopped by the turret positioning mechanism, thereby making preparations for a next supply yarn fitting operation. In case no supply yarn is detected by the photoelectric sensor 30 even after such rotating operation, this means that supply yarns have been used up, and by exchanging the turret platform for another turret platform on which supply yarns are reserved, a supply yarn can be supplied.

Further, by providing a photoelectric sensor 38 at such a location as shown in FIG. 4, a supply yarn supplementing timing can be recognized in advance.

Figure 5:
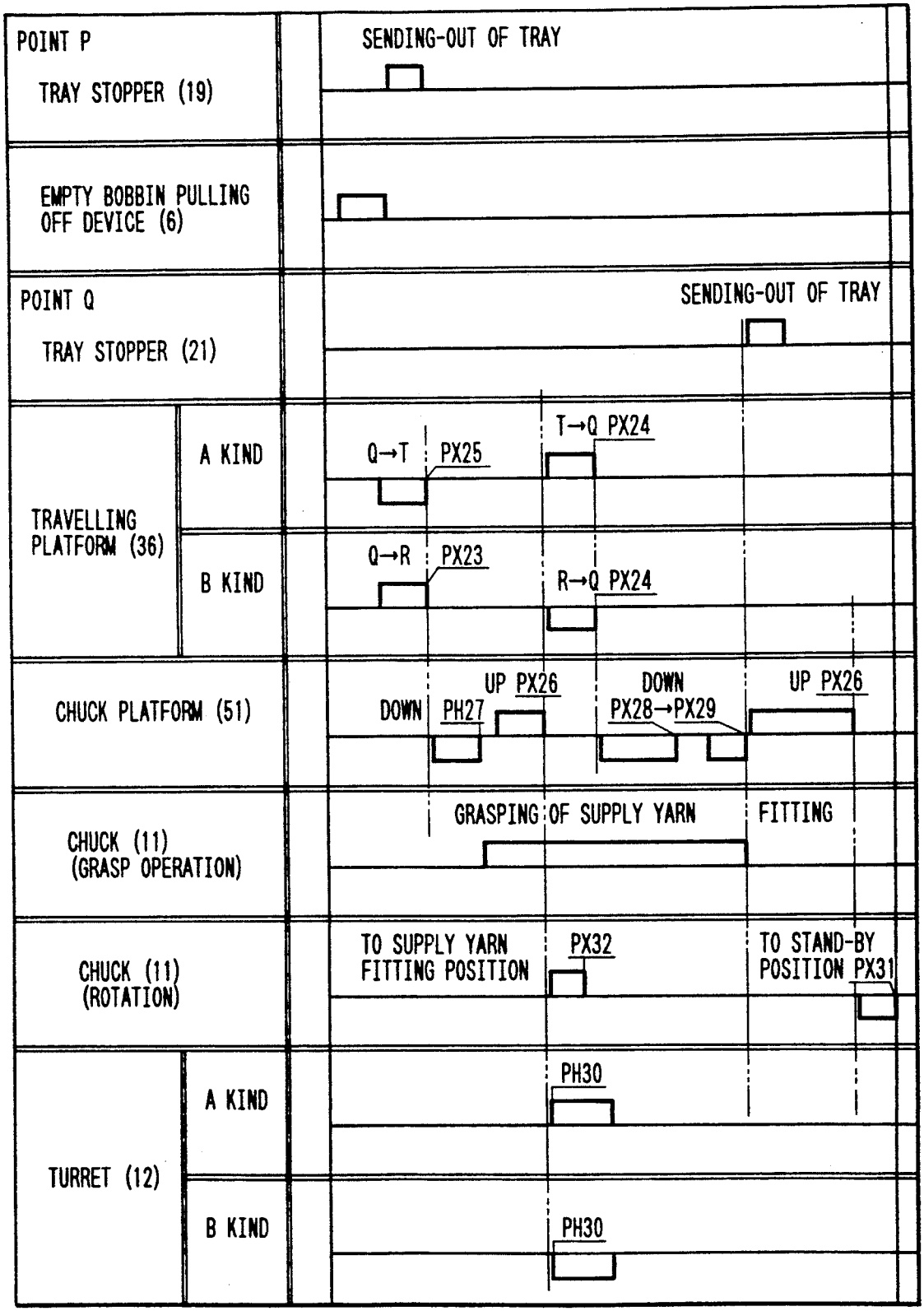
FIG. 5 is a timing chart.

Such operations as described above are summarized into a timing chart and shown in FIG. 5. In the figure, for example, reference characters PX25, PH30 and so forth are abbreviated representations of the proximity sensor 25 and the photoelectric sensor 30 and represent that an input of the sensor indicates starting or completion of an operation.

In the present embodiment, treatment of two kinds is made possible by supplying supply yarns of two different kinds to the individual turrets 12 and moving the supply yarn fitting device 9 to locations corresponding to the individual turrets 12. This makes it easy to cope with an increased number of kinds by increasing the number of positions of movement of the supply yarn fitting device 9 and the number of such turrets 12. Further, it is also possible to use, other than turrets, a reserving device having a plurality of sections in which supply yarns of different kinds are individually reserved and to move the fitting device to each of the sections to supply supply yarns of several kinds.

Further, it is also possible to supply supply yarns of different kinds to the individual bar-like members 13 of the turrets 12, identify the individual bar-like members 13 and rotate the turrets 12 to supply a supply yarn of a necessary kind. Further, it is also possible to use, other than turrets, a reserving device having a plurality of sections in which supply yarns of different kinds are individually reserved and to move the reserving device to supply supply yarns of several kinds.

Figure 7:
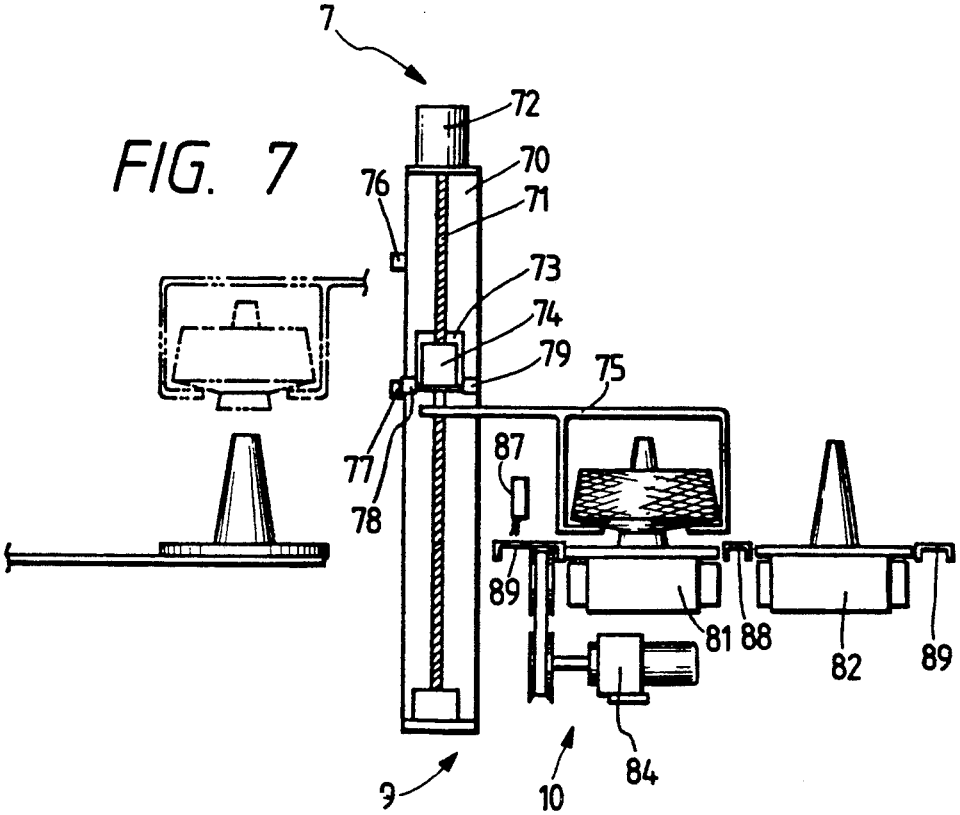
FIGS. 7 and 8 are a front elevational view and a plan view of a second embodiment.
Figure 8:
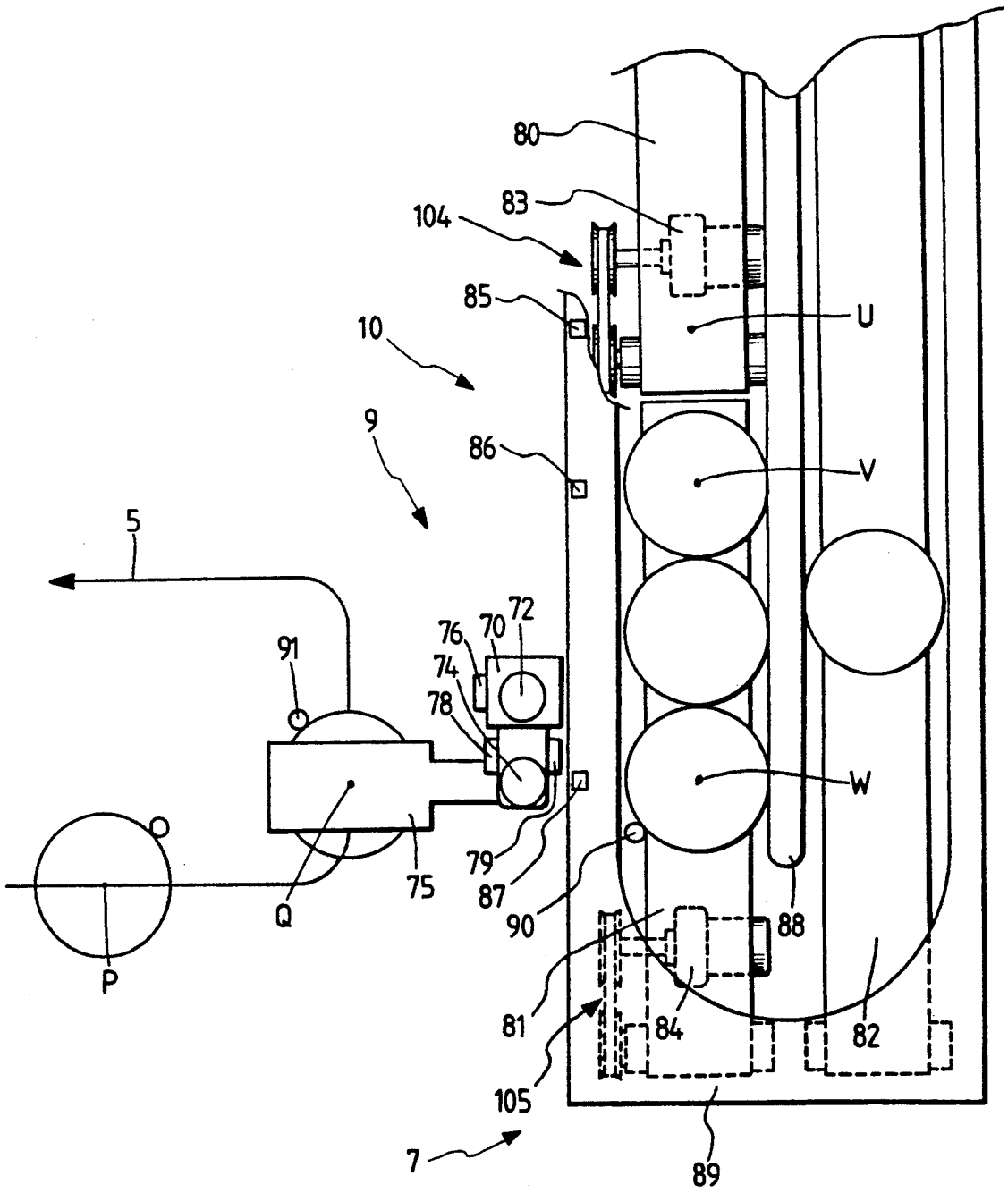

A second embodiment is an example wherein a supply yarn of the shape of a cone fitted uprightly on a peg tray is transported by means of a conveyor and then reserved as it is on the conveyor. FIGS. 7 and 8 show a front elevational view and an arrangement in plan, respectively. Components other than a supply yarn fitting device 9 and a supply yarn reserving device 10 are similar in construction to those of the embodiment 1. However, since the present example treats an example wherein supply yarns are of a single kind, no kind discriminating sensor is used.

Reference numeral 70 denotes a guide member installed uprightly, and 71 a ball screw which is driven by a motor 72 secured to the guide member 70. Reference numeral 73 denotes a lift table, and a nut (not shown) in which the ball screw 71 is screwed is mounted on the lift table 73. Meanwhile, two rollers (not shown) are mounted on the lift table 73 such that they may contact with the guide member 70 so that the lift table 73 may be moved up or down by rotation of the motor 72. A motor 74 is secured to the lift table 73, and a carrier 75 having a substantially channel-shaped sectional shape is mounted on a shaft of the motor 72. Reference numerals 77 and 78 denote each a proximity sensor secured to the guide member 70 for detecting the height of the lift table 73, and 77 and 78 denote each a proximity sensor secured to the lift table for detecting a rotational position of the carrier 75.

Reference numerals 80, 81 and 82 denote each a conveyor for transporting a peg tray, and the conveyors 80 and 81 are driven in a direction in which they move from above to below of FIG. 3 by motors 83 and 84, respectively. Meanwhile, the conveyor 82 is driven in a direction in which it moves from below to above in FIG. 3 by a motor not shown. Reference numeral 91 denotes a stopper for stopping a peg tray on an annular conveyor 5, and the stopper 91 is moved up or down by an air cylinder not shown. Reference numerals 85, 86 and 87 denote each a photoelectric sensor for detecting a peg tray, and the photoelectric sensors 85, 86 and 87 detect peg trays at points U, V and W, respectively. Further, reference numerals 88 and 89 denote each a guide for the transportation of a peg tray.

Subsequently, action of the second embodiment will be described. As shown in an alternate long and two short dashes line in FIG. 7, in a standby condition, a cone-shaped supply yarn is loaded on the carrier 75 and waits at a position at which a supply yarn can be fitted uprightly onto an empty tray at a point Q of the supply yarn supply device on the annular conveyor 5, that is, a position the rotational position and the lifting position of which are indicated by the proximity sensors 78 and 76.

An empty tray arrives at the point Q of the annular conveyor 5 and is temporarily stopped there by the stopper 91. After the motor 72 is driven in the counterclockwise direction so that the supply yarn is moved down to a position indicated by the proximity sensor 77 and fitted uprightly onto the peg tray, the stopper 90 is temporarily disengaged to allow the peg tray to be fed while at the same time the carrier 75 is rotated in the counterclockwise direction by the motor 72 and is stopped at a position at which pulling off of the supply yarn from the peg tray stopped by the stopper 91 at the point W on the conveyor 81. The stopping position is indicated by the proximity sensor 79. The carrier is rotated in the clockwise direction after it is moved up to the position for the supply standby indicated by the sensor 76, and is then stopped at the supply standby position indicated by the sensor 78, thereby completing a series of operations of the supply yarn fitting device 9.

In the present embodiment, the supply yarn reserving device 10 is constituted from the conveyors 81 and 80. After the supply yarn is pulled off by the carrier 75 at the point Q, the motor 84 is rendered operative and the stopper 90 is temporarily disengaged. Consequently, the emptied peg tray is transported away by the conveyors 81 and 82, and the conveyor 81 operates until the peg tray is detected simultaneously at the point V and at the point W while the conveyor 80 continues its operation until the peg tray is fed to both of the point U and the point V. Supply yarns are supplied successively by such operation of the conveyors 80 and 81.

As described so far, according to the present invention, successive supply of supply yarns is enabled by movement of such fitting device as in the first embodiment and by operation of such reserving device as a turret in the first embodiment or a conveyor in the second embodiment.

What is claimed is:

1. A yarn supply device for an automatic winder, the automatic winder including a plurality of trays for carrying a plurality of different types of supply yarn packages, each tray including indicator mean for identifying the type of supply yarn package carried by the tray, the yarn supply device comprising:

extracting means, defining an extracting position, for extracting an empty bobbin from a tray located at the extracting position, sensing means for detecting the indicator means of a tray located at the extracting position and for identifying the type of supply yarn package carried by the tray, supply yarn fitting means for supplying a supply yarn package to a tray from which an empty bobbin has been extracted, and supply yarn reserving means, responsive to the sensing means, for storing a plurality of different types of supply yarn packages and for supplying a supply yarn package to the supply yarn fitting means in response to the type of supply yarn package identified by the sensing means, whereby the type of supply yarn package supplied to the supply yarn fitting means corresponds to the type of supply yarn package carried by the tray.

2. The device as claimed in claim 1, wherein the supply yarn package defines a neck portion and wherein the supply yarn fitting means comprises:

a chuck for grasping the neck portion of a supply yarn package and for performing vertical movement, horizontal movement, and rotational movement between a supply yarn fitting position and a supply grasping position.

3. The device as claimed in claim 2, wherein the supply yarn fitting means comprises:

a base, a travelling platform for performing horizontal movement relative to the base, a chuck platform in mechanical contact with the chuck for performing vertical movement relative to the base, and sensor means for sensing the position of the travelling platform and the chuck platform.

4. The device as claimed in claim 3, wherein the chuck comprises:

at least two chuck members, means for causing relative pivotal motion between the at least two chuck members, and sensing means for sensing the position of the chuck.

5. The device as claimed in claim 1, wherein the supply yarn reserving means comprises:

a turret, a bar-like member in mechanical contact with the turret, the bar-like member being configured to receive cheeses of supply yarns, and means for rotating the turret.

6. The device as claimed in claim 5, wherein the turret defines a relative rotational position and further comprising means for establishing the relative rotational position of the turret.

7. A device as claimed in claim 6, wherein the turret defines at least one recess and wherein the means for establishing the relative rotational position of the turret comprises a roller for engaging the recess under pressure.

* * * * *